US006897611B2

(12) United States Patent
Hitzschke et al.

(10) Patent No.: US 6,897,611 B2
(45) Date of Patent: May 24, 2005

(54) DISCHARGE LAMP HAVING CAPACITIVE FIELD MODULATION

(75) Inventors: Lothar Hitzschke, Munich (DE); Frank Vollkommer, Buchendorf (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 10/130,754

(22) PCT Filed: Sep. 5, 2001

(86) PCT No.: PCT/DE01/03406

§ 371 (c)(1),
(2), (4) Date: May 23, 2002

(87) PCT Pub. No.: WO02/27760

PCT Pub. Date: Apr. 4, 2002

(65) Prior Publication Data

US 2002/0163305 A1 Nov. 7, 2002

(30) Foreign Application Priority Data

Sep. 29, 2000 (DE) ..... 100 48 409

(51) Int. Cl.[7] ..... H01J 11/00
(52) U.S. Cl. ..... 313/607; 313/594
(58) Field of Search ..... 313/607, 634, 313/631, 594, 600–604, 234, 595, 24, 493, 635, 117; 315/246, 287

(56) References Cited

U.S. PATENT DOCUMENTS 4,803,399 A * 2/1989 Ogawa et al. ..... 313/493
5,101,330 A * 3/1992 Suzuki ..... 362/256
5,101,331 A * 3/1992 Katoh et al. ..... 362/256
5,382,879 A * 1/1995 Council et al. ..... 315/248
5,760,541 A 6/1998 Stavely et al.
5,869,931 A * 2/1999 Terada ..... 313/607
5,886,468 A * 3/1999 Terada et al. ..... 313/607
5,889,366 A * 3/1999 Yokokawa et al. ..... 313/607
5,903,095 A * 5/1999 Yoshida et al. ..... 313/485
5,932,960 A * 8/1999 Terada et al. ..... 313/485
5,965,988 A * 10/1999 Vollkommer et al. ..... 315/246
6,018,218 A * 1/2000 Terada et al. ..... 313/488
6,060,828 A 5/2000 Vollkommer et al.
6,084,360 A * 7/2000 Yokokawa et al. ..... 315/287
6,097,155 A * 8/2000 Vollkommer et al. ..... 315/58
6,150,758 A * 11/2000 Tamura ..... 313/488
6,222,647 B1 * 4/2001 Tadenuma et al. ..... 358/475
6,252,352 B1 6/2001 Vollkommer et al.
6,288,490 B1 * 9/2001 Popov ..... 313/607
6,304,028 B1 * 10/2001 Vollkommer et al. ..... 313/491
6,331,064 B1 * 12/2001 Nishiyama et al. ..... 362/260
6,407,513 B1 * 6/2002 Vollkommer et al. ..... 315/246
6,531,832 B1 * 3/2003 Hirata et al. ..... 315/241 P
6,545,427 B1 * 4/2003 Vollkommer et al. ..... 315/246
6,601,984 B2 * 8/2003 Yamamoto et al. ..... 362/555
6,614,185 B1 * 9/2003 Nishimura et al. ..... 313/607
6,727,649 B1 * 4/2004 Yano et al. ..... 313/607
6,777,878 B2 * 8/2004 Berlinghof et al. ..... 315/58

FOREIGN PATENT DOCUMENTS

| | | |
|---|---|---|
| DE | 198 17 479 | 6/1999 |
| DE | 198 44 720 | 4/2000 |
| DE | 199 55 108 | 5/2001 |
| WO | WO 94/23442 | 10/1994 |
| WO | WO 94/27312 | 11/1994 |

* cited by examiner

*Primary Examiner*—Joseph Williams
*Assistant Examiner*—Dalei Dong
(74) *Attorney, Agent, or Firm*—Robert F. Clark

(57) ABSTRACT

The invention relates to the capacitive modulation of the field distribution in a silent discharge lamp 1, by a structured, electrically conductive device 2 for definition of preferred locations for discharge structures in the lamp 1.

20 Claims, 2 Drawing Sheets

DISCHARGE LAMP HAVING CAPACITIVE FIELD MODULATION

TECHNICAL FIELD

The present invention relates to what is referred to as a silent discharge lamp, also called a dielectric barrier discharge lamp, which is designed for dielectric barrier discharges. Such a discharge lamp has a discharge vessel which contains the discharge medium, in which discharges are ignited and maintained via electrodes. Silent discharge lamps are operated with dielectric barrier discharges, with at least some of the electrodes being isolated from the discharge medium by a dielectric coating. If the electrodes are designed specifically as cathodes and anodes, that is to say are intended for operation with a uniform polarity, then at least the anodes must be isolated from the discharge medium by this dielectric coating. For bipolar operation, all the electrodes must isolated from the discharge medium by means of a dielectric coating. Such a dielectric coating may also be used for a wall of the discharge vessel. The discharge medium generally consists of a gas mixture, and normally contains noble gases, for example xenon.

PRIOR ART

Normally, the relevant prior art and the specialist literature can be referred to with regard to silent discharge lamps in general.

U.S. Pat. No. 6,252,352 B1 forms a more specific prior art, which is of interest for the present application. This document describes silent discharge lamps with electrodes in the form of strips, on which projections are provided at specific intervals, in order to define preferred locations for individual discharge structures. This is intended to avoid uncontrolled migration, extinguishing and reoccurrence of such discharge structures, with the physical distribution of the discharge structures being organized systematically in the discharge area. The cited prior art in this case relates to the increase in the homogeneity of the light intensity distribution in what are referred to as flat lighting elements, that is to say flat silent discharge lamps, which are of particular interest for background illumination for displays of widely differing types. Reference is also made to the even older U.S. Pat. No. 6,060,828.

However, it may also be desirable for other reasons to be able to influence the arrangement of individual discharge structures in the discharge area.

Such individual discharge structures occur in silent discharge lamps in particular when the pulsed operating mode explained in WO94/23442 is used, in which case Δ-shaped individual discharges are produced. Depending on the operating parameters, such discharges can also occur more widely and may even form continuous "curtains" while in individual cases they may also be split apart, and the like. This is a question of the electrode design and of the various discharge lamp operating parameters. These details are not significant to the present invention. The invention also relates in general to silent discharge lamps in which, in circumstances other than those described in the cited WO document, stable discharge structures which can be localized may likewise be formed. The invention is thus not restricted to the teaching of the WO document.

DESCRIPTION OF THE INVENTION

The invention is based on the technical problem of specifying a silent discharge lamp of the general type described initially, in which the local distribution of individual discharge structures in the discharge area can be influenced. In this case, the invention is aimed at those silent discharge lamps which have an extent in at least one direction, which is referred to in the following text as the longitudinal direction. In this case, they may also, of course, extend in a second direction as well, that is to say they may be flat.

In general, the invention is defined as a discharge lamp for dielectric barrier discharges having a discharge vessel which is filled with a discharge medium and having discharge electrodes, which are at least partially isolated from the discharge medium by a dielectric coating, with the discharge vessel extending along at least one longitudinal direction, characterized by a device which is electrically conductive, is electrically DC-decoupled from the electrodes but is capacitively AC-coupled to at least one of the electrodes, with the conductive device being designed, by means of the capacitive coupling to the electrode, to modulate the equipotential lines, which are defined by the electric field between the electrodes, along the longitudinal direction.

This invention is based on the knowledge that the distribution of discharge structures in the discharge area can be achieved not only by an inhomogeneous configuration of the electrodes themselves. In fact, according to the invention, a device for capacitively influencing the field distribution in the discharge area is proposed, which is DC-decoupled from the electrodes (that is to say is isolated as far as direct current is concerned). The electrodes may thus have a completely uniform shape, for example be in straight strips (although they are not restricted to uniform configurations). Since the operating frequencies of dielectric barrier discharges are in any case relatively high, capacitive coupling of the device according to the invention allows the field distribution to be influenced by alternating current. For illustrative purposes, we can imagine that the device for capacitive influencing (referred to as a capacitive device in the following text) according to the invention forms AC taps with respect to the electrode or electrodes, or the discharge area. The capacitive device thus distorts the equipotential lines in the discharge area.

According to the invention, this is preferably done in an oscillatory manner in the longitudinal direction along the extent of the discharge lamp. In this case, the term "oscillatory" indicates that the equipotential lines are distorted, so to speak, in a sense running "up and down" or "to and fro". This oscillatory distortion may, but need not be, periodic. However, periodic modulation of the equipotential lines forms a preferred case.

It is evident from the cited prior art that the individual discharge structures are arranged as a function of the field distribution. The distortion of the equipotential lines in this case results in preferred locations according to the invention for discharge structures, by means of which it is possible to ensure a specific arrangement of the discharge structures in the desired manner. The capacitive device thus forms an alternative to the structuring of the electrodes themselves which is cited in the described prior art. The invention may thus be of interest, for example, in order to avoid electrode structuring, for example to provide homogeneously continuous electrodes in order to simplify the production process or because the accessibility to the locations intended for the electrodes is poor. In general, the capacitive device according to the invention, which must be composed of electrically conductive material, does not involve any major technical complexity and can also, in particular, be installed outside the discharge vessel, and need not even touch it.

The invention thus makes it possible to dispense with special structuring of the electrodes for producing preferred locations for discharge structures. However, such structuring is not precluded. In particular, such structuring can be corrected, added to or, if desired, compensated for by the measures according to the invention. In particular, the modulation according to the invention can also be used for edge brightening, in which context reference should be made to the third, fourth and fifth exemplary embodiments. It is therefore not absolutely essential for the modulation to be 1:1-matched to the discharge structure distribution by means of the capacitive device. However, it is preferable for the capacitive modulation to be matched to the distances between the discharge structures. However, for example, the capacitive modulation may also correspond to multiples of the distances between the discharges, with an intermediate subdivision by means of other measures being provided within these multiple distances. The matching of the oscillation length scale to the intermediate distances should also be understood in this sense.

According to the invention, a length range of at most 6 times, or better 5 times, 4 times or even at most 3-times, the discharge distance has been found to be the preferred range for this oscillation length scale.

The capacitive device can be provided in duplicated or multiple form, in order "to impress" preferred discharge locations from different sides of the discharge vessel. A capacitive device, or one of the capacitive devices, can, of course, also influence the equipotential lines in the region of two or more electrodes. According to the invention, it is preferable for the capacitive device to be provided in at least duplicated form, in the sense of being in two parts, and for the devices, or parts of the device, to cover both electrode polarities of the lamp. This is advantageous especially in the case of bipolar-operated discharge lamps since, in general, it is possible to provide the cathodes or the region of the cathodes with preferred locations for discharges, since the discharges are more sharply localized there than in the region of the anodes. In bipolar operation, all the electrodes act as cathodes in certain operating phases. Furthermore, holders for a discharge lamp can easily be constructed using two capacitive devices, or two parts of such a device, which holders would be required in any case, and thus restrict the complexity required in the case of the invention to suitable structuring of the holders. In this context, reference should be made to the second exemplary embodiment.

This modulation is preferably provided over essentially the same extent of the discharge lamp, at least in the one longitudinal direction and, furthermore, is preferably essentially periodic, at least over this entire length. This makes it possible to achieve the homogeneity of the light intensity distribution, which is generally a major factor with discharge lamps such as these.

If, according to a further preferred embodiment of the invention, the capacitive device is arranged outside the discharge vessel, and the electrodes, that is to say at least the electrodes in the region of the capacitive device, are arranged within the discharge vessel, then this itself results in the DC decoupling already mentioned. Isolation between the capacitive device and the electrodes can, of course, also be provided when the electrodes are located outside the discharge vessel. As already mentioned, the capacitive device is preferably a discharge vessel holder, or a part of such a holder.

The effect according to the invention is particularly pronounced if the capacitive device produces capacitive coupling between the electrode that is coupled to it and an associated opposing electrode of relatively closely located parts of the discharge area. This results in an effect which is comparable to effective electrode broadening.

An earlier patent application (DE-A 199 55 108) from the same applicant explained that an external thermal device allows the heat transport into the discharge lamp or from the discharge lamp to be influenced in an inhomogeneous manner. This is intended to counteract the intrinsically inhomogeneous eigen-temperature response of the discharge lamp, in order to produce discharge conditions which are as homogeneous as possible, and hence a homogeneous light intensity distribution.

The invention is related to the problems dealt with in the invention there as follows: the capacitive device, in the sense of the present application, allows a certain amount of temperature homogenization to be achieved along the at least one longitudinal direction of the discharge lamp. In detail, this depends on how good the thermal contact is between the capacitive device and the discharge vessel. The structuring of the capacitive device required by the modulation of the field distribution does not necessarily stand in the way of this temperature homogenization since such modulation is intended to be carried out with a length scale matched to the intermediate discharge distances. The temperature inhomogeneities in the discharge lamp generally occur over a longer length scale, however. This is because the discharge lamp is normally warmer in the center than at the edge, with a continuous profile in between. The structuring which is required for modulation of the field distribution can thus in theory admittedly lead to slight modulation of the temperature distribution, provided the thermal contact with the discharge vessel is good. However, temperature fluctuations on the length scale of the intermediate discharge distances which, however, are repeated over the extent of the lamp with this modulation, are insignificant since they essentially affect all the discharge structures in the same way.

Furthermore, the thermal device defined in the cited application can, in fact, also be combined with the present invention. The thermal device according to the cited application and the capacitive device according to the present application can thus be provided at the same time, and, in particular, they may also be combined. To this end, the thermal/capacitive device may have a thermally inhomogeneous effect matched to the eigen-temperature response of the lamp, for example by means of differently pronounced thermal conductivity. If characteristics which are not critical are used for the capacitive effect in this case, the field modulation can remain completely unaffected by this. By way of example, the material thickness or the material itself could be chosen such that the device provides stronger cooling in the center of the lamp than at the edge. Equally well, a thermally conductive connection to a cooling device could be provided only in the center, and so on. In particular, even inhomogeneously arranged cooling ribs may be used. Reference should be made to the cited prior application for the various design options for the thermal device, and the disclosure content of this prior application is also included here.

If the thermally inhomogeneous influencing of the lamp is carried out by insulation measures in that the ends of the lamp, which tend to be cold, are insulated, then this may be done in any case independently of the capacitive device.

The discharge lamp according to the invention is preferably provided with a ballast which is matched to the already mentioned pulsed operating method. Based on the present level of knowledge, localized discharge structures can be produced in a particularly efficient manner using this method.

The invention can be used in particular for elongated discharge lamps in the form of rods. Firstly, these are a preferred application for the "thermal homogenization" which has been explained, and secondly, particularly in discharge lamps such as these, it may be difficult to install structured electrodes, particularly if they are intended to be located within the discharge vessel. However, electrodes within the discharge vessel are frequently desirable in order to reduce the voltages required for starting and operation. In contrast to relatively open two-dimensional situations, in which, for example, screen-printing methods can be used, an electrode which is provided with projections or other geometrical elements in order to define preferred points for discharges can be produced only with difficulty within a discharge vessel in the form of a glass tube. In this situation, the invention offers a more feasible approach, particularly if the holder, which is required in any case, is designed according to the invention.

Striplights such as these are of particular interest for copying devices or scanning devices, in which a striplight has to be passed over an optical area to be scanned, for example the surface of a piece of paper.

However, the invention is also suitable for flat lighting elements which, as mentioned, form a major field of application for silent discharge lamps, in particular, for background illumination for display devices.

DESCRIPTION OF THE DRAWINGS

Various exemplary embodiments of the invention will be explained in more detail in the following text. The features disclosed in this case may also be significant to the invention in combinations other than those illustrated. In detail:

FIG. 1 illustrates the fundamental principle of the invention using a simple exemplary embodiment. 1 denotes a silent striplight discharge lamp, which essentially consists of an elongated glass tube. The details of the electrode structure are not shown here, but can be seen in principle in FIG. 2. Reference should be made to the document U.S. Pat. No. 6,097,155 for details of such silent striplight discharge lamps.

The potential distribution produced by the electrodes within this striplight discharge lamp 1 can be modulated within the discharge vessel, namely the glass tube, by the metal plate which is annotated 2. The metal plate has a comb-like structure, which extends vertically in FIG. 1, with the upper ends of the tines 3 of this comb structure resting against the striplight discharge lamp 1.

Figure 2:
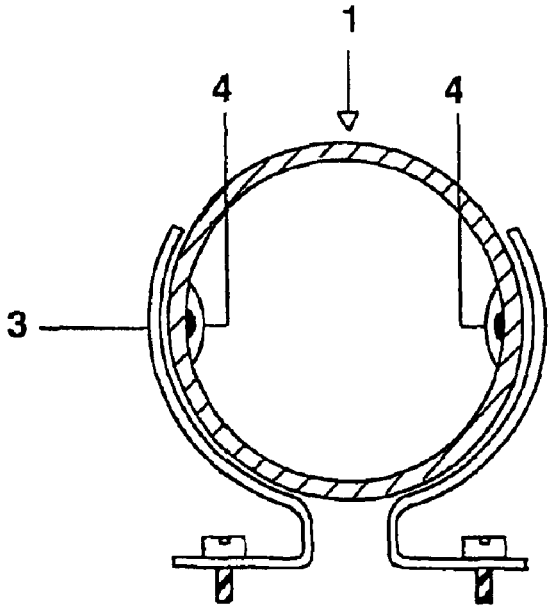
FIG. 2 shows a variant of FIG. 1 as a second exemplary embodiment, to be precise in a section along the longitudinal axis.

FIG. 2 shows that the tines 3 may also partially enclose the lamp 1. In addition, FIG. 2 shows a cross section of the internal electrodes 4 of the striplight discharge lamp.

The tines 3 are coupled to the interior of the discharge vessel of the striplight discharge lamp 1 in the manner already explained. This is a purely capacitive effect, in which there is complete DC-decoupling between the electrodes 4 and the tines 3, and between the interior of the discharge vessel and the tines 3. If the plate 2 is structured as a capacitive device in the sense of the invention, this results in modulation of the equipotential lines which, since the electrode strips 4 are designed to be homogeneously in the form of strips, generally run essentially without any disturbance along the longitudinal extent of the striplight discharge lamp 1. The comb structure of the plate 2 thus impresses a structure with the same oscillation length on the field distribution within the striplight discharge lamp 1 with, in this example, periodic oscillation occurring virtually over the entire length of the striplight discharge lamp 1. The discharge structures within the striplight discharge lamp 1 are distributed accordingly, and are preferably seated at the points of the tines 3 within the discharge vessel. In the second exemplary embodiment, shown in FIG. 2, this effect occurs to a greater extent than in the first exemplary embodiment shown in FIG. 1, since the tines 3 are each passed through a quarter of the circumference around the striplight discharge lamp 1. This modulation can also be regarded as effective broadening of the electrode.

Figure 1:
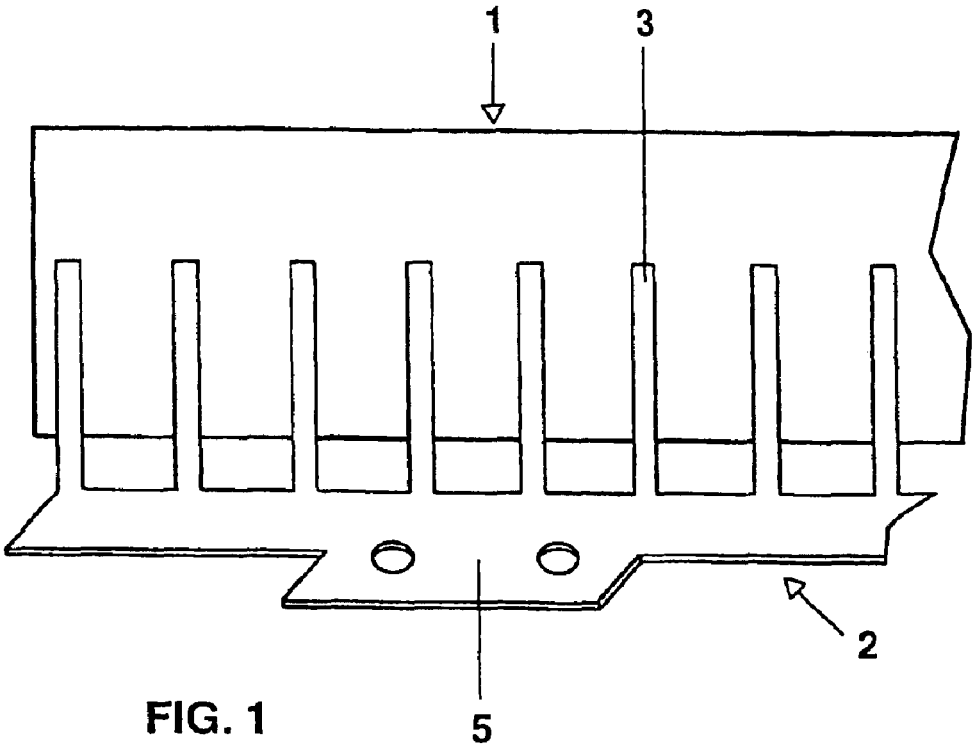
FIG. 1 shows a schematic view of a silent striplight discharge lamp according to the invention as a first exemplary embodiment.

In addition, FIG. 1 shows that the plate 2 is mounted only in a central region, in the longitudinal extent of the striplight discharge lamp 1, by means of a relatively broad sheet-metal part 5 and two screws. In this case, it can also be mounted on a heat sink, as a result of which the plate 2 acts, overall, as a cooling device. If the tines 3 are designed to be somewhat broader than shown and make relatively good thermal contact with the striplight discharge lamp 1, for example by a part of the cross-sectional circumference resting against it, as illustrated in FIG. 2, the plate 2 forms an inhomogeneous cooling device in the sense of the earlier invention already mentioned, without the capacitive coupling becoming inhomogeneous in the same way in consequence.

Figure 3:
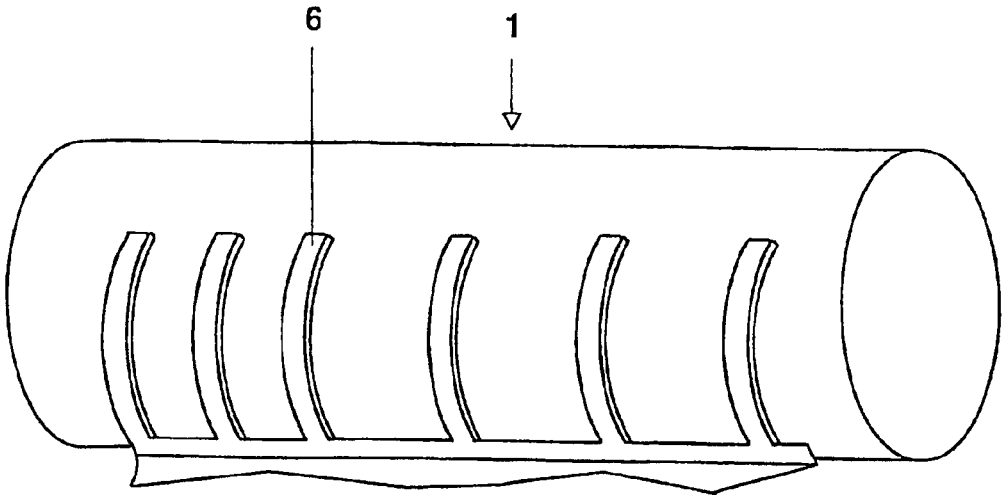
FIG. 3 shows a third view of a variant relating to FIG. 2, as a third exemplary embodiment.

FIG. 3 shows, in highly schematic form, an alternative arrangement of tines of a comb structure which is otherwise comparable, with the tines in this case being annotated 6. The tines are arranged closer together in edge region of the striplight discharge lamp 1 that is on the left in FIG. 3 than in a central region which is shown on the right in FIG. 3, thus resulting in a closer arrangement of discharge structures in the striplight discharge lamp 1. This results in the edge region being brightened. Such edge brightening may be worthwhile for various reasons, and in particular it may be chosen in order to compensate for edge darkening which would otherwise occur, that is to say basically being used just to homogenize the light intensity distribution. With regard to edge brightening in general, reference should be made to the already cited U.S. Pat. No. 6,252,352 B1.

Figure 4:
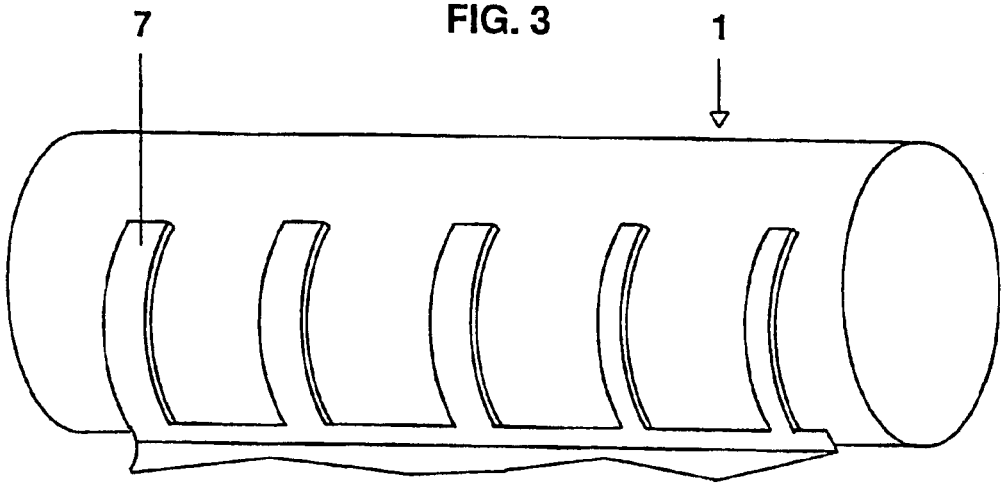
FIG. 4 shows a schematic view of a further variant relating to FIG. 3, as a fourth exemplary embodiment.

The tines 7 illustrated in FIG. 4 represent a variant of FIG. 3 as a fourth exemplary embodiment. In this case, the tines 7 in the edge region of the striplight discharge lamp which can be seen on the left are designed to be broader rather than being arranged closer together. The discharge structures in the edge region thus burn more brightly than in the central region of the striplight discharge lamp 1, located on the right in FIG. 4. With regard to both FIGS. 3 and 4, it should be noted that the heterogeneity of the respective tine structures 6 and 7 is illustrated somewhat emphasized towards the edge. In a practical embodiment, the heterogeneity is generally pronounced only sufficiently to ensure that the light intensity distribution is as homogeneous as possible overall.

Figure 5:
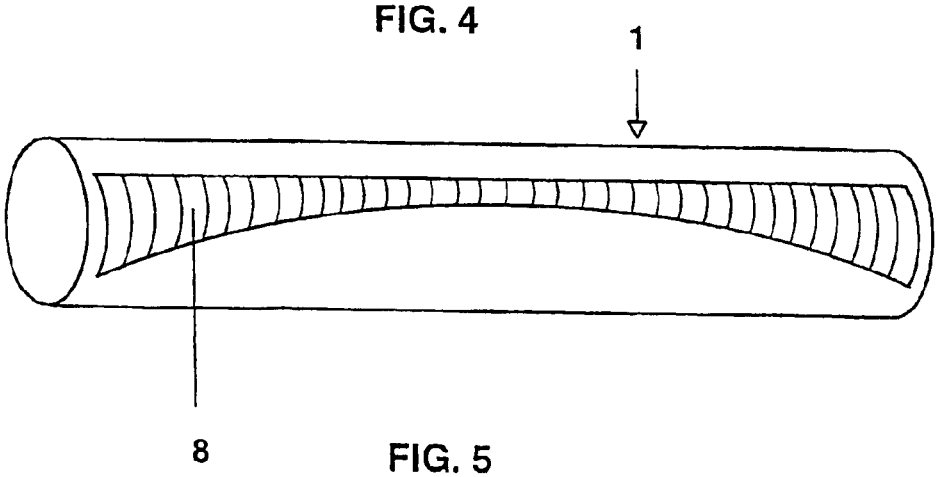
FIG. 5 shows a schematic view of a silent striplight discharge lamp according to the invention, as a fifth exemplary embodiment.

FIG. 5 shows the fifth exemplary embodiment, likewise in the form of a highly schematic illustration. 1 once again denotes the striplight discharge lamp already explained. A metal strip, which is annotated 8, is mounted on this, is relatively broad in the left and right outer regions, and is relatively narrow in the central region, with the transitions between these regions being continuous. In the fifth exemplary embodiment, it is assumed that the electrode strips within the striplight discharge lamp 1 are not structured, but a continuous curtain-like discharge burns owing to the lamp power being high. (However, the electrode strips may also be structured, as is already known from the prior art). Here, the only object of the invention is to ensure the edge brightening which has already been explained. Accordingly, although the capacitive device 8 modulates the field lines over essentially the entire length of the striplight discharge lamp 1, this is independent of intermediate discharge distances. This modulation could also be carried out exclusively in the edge region. However, according to the invention, the modulation according to the invention is intended to be present at least in the edge region of the longitudinal extent of the silent discharge lamp, or over essentially its entire length in the longitudinal direction.

This modulation is oscillatory in the sense that it corresponds to a "to-and-fro" or "up-and-down" movement with an intermediate maximum and minimum. This would still occur even if the central region of the metal strip 8 were omitted.

The fifth exemplary embodiment from FIG. 5 could, of course, also be combined with the first or second exemplary embodiment, so that it is possible to dispense with structuring of the electrode strips 4 themselves.

What is claimed is:

1. A discharge lamp comprising:

a discharge vessel which is elongated in at least one direction, the discharge vessel containing a discharge medium and having discharge electrodes extending in a longitudinal direction, the electrodes being arranged on a wall of the discharge vessel and being at least partially isolated from the discharge medium by a dielectric coating; and an electrically conductive capacitive device located outside the discharge vessel and having tines which are electrically DC-decoupled from the electrodes, the tines being disposed on or adjacent to an external wall of the discharge vessel for capacitive AC-coupling to the electrodes during lamp operation.

2. The discharge lamp of claim 1 wherein the tines are equally spaced along the longitudinal direction.

3. The discharge lamp of claim 1 wherein the tines are spaced closer together in an edge region of the discharge vessel than in a central region of the discharge vessel.

4. The discharge lamp of claim 1 wherein the tines partially enclose the discharge vessel.

5. The discharge lamp of claim 1 wherein the tines rest against the discharge vessel.

6. The discharge lamp of claim 1 wherein the tines have equal widths.

7. The discharge lamp of claim 1 wherein the tines are broader in an edge region of the discharge vessel than in a central region of the discharge vessel.

8. The discharge lamp of claim 1 wherein the capacitive device is a holder for the discharge vessel.

9. A discharge lamp comprising:

a discharge vessel comprising an elongated glass tube containing a discharge medium, the discharge vessel having two opposed discharge electrodes extending in a longitudinal direction, the electrodes being arranged on a wall of the discharge vessel and being at least partially isolated from the discharge medium by a dielectric coating; and an electrically conductive capacitive device located outside the discharge vessel and having tines which are electrically DC-decoupled from the electrodes, the tines being disposed on or adjacent to an external wall of the discharge vessel for capacitive AC-coupling to the electrodes during lamp operation.

10. The discharge lamp of claim 9 wherein the tines are equally spaced along the longitudinal direction.

11. The discharge lamp of claim 9 wherein the tines are spaced closer together in an end region of the discharge vessel than in a central region of the discharge vessel.

12. The discharge lamp of claim 9 wherein the tines partially enclose the discharge vessel.

13. The discharge lamp of claim 9 wherein the tines rest against the discharge vessel.

14. The discharge lamp of claim 9 wherein the tines have equal widths.

15. The discharge lamp of claim 9 wherein the tines are broader in an edge region of the discharge vessel than in a central region of the discharge vessel.

16. The discharge lamp of claim 9 wherein the capacitive device is a holder for the discharge vessel.

17. The discharge lamp of claim 9 wherein the tines rest against and partially enclose the discharge vessel.

18. A discharge lamp comprising:

a discharge vessel comprising an elongated glass tube containing a discharge medium, the discharge vessel having discharge electrodes extending in a longitudinal direction, the electrodes being arranged on a wall of the discharge vessel and being at least partially isolated from the discharge medium by a dielectric coating; and a capacitive device located outside of the discharge vessel and comprising an electrically conductive strip extending in the longitudinal direction, the strip being broader in an end region of the discharge vessel than in a central region of the discharge vessel, the strip being electrically DC-decoupled from the electrodes and disposed on or adjacent to an external wall of the discharge vessel for capacitive AC-coupling to the electrodes during lamp operation.

19. The discharge lamp of claim 18 wherein the capacitive device is disposed on the external wall of the discharge vessel.

20. The discharge vessel of claim 18 wherein the capacitive device is a metal strip.

* * * * *